US012648644B2

(12) United States Patent
Tan

(10) Patent No.: US 12,648,644 B2
(45) Date of Patent: Jun. 9, 2026

(54) ZERO-GRAVITY AND ZERO-WALL CHAIR FRAME

(71) Applicant: DONGGUAN CITY RUIHAO FURNITURE MANUFACTURING CO., LTD., Dongguan (CN)

(72) Inventor: Changming Tan, Dongguan (CN)

(73) Assignee: DONGGUAN CITY RUIHAO FURNITURE MANUFACTURING CO., LTD., Dongguan (CN)

( * ) Notice: Subject to any disclaimer, the term of this patent is extended or adjusted under 35 U.S.C. 154(b) by 288 days.

(21) Appl. No.: 18/577,836

(22) PCT Filed: Jul. 18, 2022

(86) PCT No.: PCT/CN2022/106231
§ 371 (c)(1),
(2) Date: Jan. 9, 2024

(87) PCT Pub. No.: WO2024/000671
PCT Pub. Date: Jan. 4, 2024

(65) Prior Publication Data

US 2024/0374031 A1 Nov. 14, 2024

(30) Foreign Application Priority Data

Jun. 29, 2022 (CN) ..... 202210748382.0

(51) Int. Cl.
*A47C 1/034* (2006.01)
*A47C 1/032* (2006.01)
(Continued)

(52) U.S. Cl.
CPC ..... *A47C 1/0352* (2013.01)

(58) Field of Classification Search
CPC . A47C 1/0355; A47C 1/0345; A47C 1/03211; A47C 1/0352; A47C 7/506; A47C 7/5068
(Continued)

(56) References Cited

U.S. PATENT DOCUMENTS 5,975,627 A * 11/1999 LaPointe ..... A47C 1/0355 297/83
6,145,924 A * 11/2000 Mero, Jr. ..... A47C 1/0355 297/83
(Continued)

FOREIGN PATENT DOCUMENTS

CN 108209254 A 6/2018
CN 207768694 U 8/2018
(Continued)

OTHER PUBLICATIONS

International Search Report in PCT/CN2022/106231 in Chinese dated Mar. 27, 2023 with English translation.
(Continued)

*Primary Examiner* — Shin H Kim
(74) *Attorney, Agent, or Firm* — Collard & Roe, P.C.

(57) ABSTRACT

The present disclosure relates to the technical field of chairs, in particular to a zero-gravity and zero-wall chair frame including a base, a seat side plate assembly, a first linkage assembly, an ottoman assembly, a driving mechanism arranged on the base, a second linkage assembly, a backrest assembly and a first driving rod connected with the output end of the driving mechanism. The seat side plate assembly and the second linkage assembly cooperate to drive the backrest assembly to move away from the wall while unfolding, and the backrest assembly will not interfere or conflict with the wall during unfolding or reclining, thus
(Continued)

realizing the zero-wall clearance placement of the chair frame in a closed position and saving the placement space of the chair frame.

9 Claims, 2 Drawing Sheets

(51) Int. Cl.
*A47C 1/035* (2006.01)
*A47C 7/00* (2006.01)

(58) Field of Classification Search
USPC ..... 297/68, 69, 75, 84
See application file for complete search history.

(56) References Cited

U.S. PATENT DOCUMENTS 7,147,278 B2 * 12/2006 Johnson ..... A47C 1/0352 297/85 R
8,308,228 B2 * 11/2012 Lawson ..... A47C 1/029 297/331
8,696,054 B2 * 4/2014 Crum ..... A47C 1/0355 297/85 M
9,386,857 B2 * 7/2016 Lawson ..... A47C 1/0355
9,433,294 B2 * 9/2016 Donovan ..... A47C 7/5068
10,842,274 B1 * 11/2020 Crawford ..... A47C 1/0345
10,932,570 B2 * 3/2021 Crawford ..... A47C 1/0355
11,284,721 B2 * 3/2022 Browning ..... A47C 7/506
11,363,886 B2 * 6/2022 Johnson ..... A47C 1/03211
11,517,109 B2 * 12/2022 Browning ..... A47C 1/03211
11,903,485 B1 * 2/2024 Lawson ..... A47C 1/0355
2005/0023869 A1 * 2/2005 Longnecker ..... A47C 7/407 297/125
2005/0104420 A1 * 5/2005 Murphy ..... A47C 1/0355 297/85 L
2007/0046075 A1 * 3/2007 Johnson ..... A47C 1/0355 297/85 L
2008/0150329 A1 * 6/2008 Lawson ..... A47C 1/0355 297/84
2008/0290710 A1 * 11/2008 Lawson ..... A47C 1/0345 297/337
2009/0256402 A1 10/2009 Smith
2014/0035395 A1 * 2/2014 Marcantoni ..... A47C 20/041 310/12.27
2015/0054315 A1 * 2/2015 Donovan ..... A47C 1/0345 297/325
2015/0272329 A1 * 10/2015 Lawson ..... A47C 1/0355 297/342
2015/0272335 A1 * 10/2015 Lawson ..... A47C 7/506 297/423.19
2015/0289655 A1 * 10/2015 Lawson ..... A47C 1/0342 297/75
2016/0022040 A1 * 1/2016 Lawson ..... A47C 1/03211 297/68
2016/0045031 A1 * 2/2016 Lawson ..... A47C 7/506 297/284.3
2018/0027965 A1 * 2/2018 Lawson ..... A47C 1/0345
2018/0242740 A1 * 8/2018 Lawson ..... A47C 1/0355
2019/0216221 A1 * 7/2019 Bryant ..... A47C 1/023
2019/0290004 A1 * 9/2019 Lawson ..... A47C 1/0355
2020/0367652 A1 * 11/2020 Crawford ..... A47C 1/0355
2023/0389705 A1 12/2023 Li et al.

FOREIGN PATENT DOCUMENTS

CN 210748189 U 6/2020
CN 210748190 U 6/2020
CN 212036846 U 12/2020
CN 213431441 U 6/2021
CN 113892772 A 1/2022
CN 113907551 A 1/2022
CN 115054079 A 9/2022
WO 2021/223327 A1 11/2021

OTHER PUBLICATIONS

Written Opinion of the International Searching Authority in PCT/CN2022/106231 in Chinese dated Mar. 27, 2023.
Chinese Office Action in Chinese Application No. 2022107483820 dated Apr. 30, 2025 with English translation.

* cited by examiner

ZERO-GRAVITY AND ZERO-WALL CHAIR FRAME

CROSS REFERENCE TO RELATED APPLICATIONS

This application is the National Stage of PCT/CN2022/106231 filed on Jul. 18, 2022, which claims priority under 35 U.S.C. § 119 of Chinese Application No. 202210748382.0 filed on Jun. 29, 2022, the disclosure of which is incorporated by reference.

TECHNICAL FIELD

The present disclosure relates to the technical field of chairs, in particular to a zero-gravity and zero-wall chair frame.

BACKGROUND

With the progress of the times and the development of science and technology, continuous improvement of productivity, more and more functional seats appear in people's production and life. The functional seats can adjust between the closed, reclined and zero-gravity positions, making people sit and lie more comfortably. However, in the process of transforming the existing seat from the closed position to the zero-gravity position, the backrest assembly of the chair is easy to interfere with the wall. In order to avoid the wall interfering with the position transformation of the seat, the seat in the closed position cannot be placed without clearance with the wall surface, resulting in a large space occupied by the seat; Moreover, the existing seats have complex structure and high production cost, and they are prone to jamming in the process of position conversion. Therefore, the defects are very obvious, and it is urgent to provide a solution.

SUMMARY

In order to solve the above technical problems, the present disclosure aims to provide a chair frame with zero-gravity and zero-wall.

In order to achieve the above object, the present disclosure adopts the following technical solution:

The present disclosure relates to a zero-gravity and zero-wall chair frame, which comprises a base, a seat side plate assembly, a first linkage assembly, an ottoman assembly, a driving mechanism arranged on the base, a second linkage assembly articulated with the base and the seat side plate assembly respectively, a backrest assembly articulated with the second linkage assembly and seat side plate assembly respectively and a first driving rod connected with the output end of the driving mechanism, wherein one end of the first driving rod penetrates the seat side plate assembly and one end of the first linkage assembly in turn, the first driving rod is rotationally connected with the seat side plate assembly, and the ottoman assembly is articulated with the other end of the first linkage assembly and the seat side plate assembly respectively.

Further, the driving mechanism comprises a driver and a second driving rod, wherein the driver comprises a cylinder, a piston arranged inside the cylinder and a slider sleeved outside the cylinder and slidingly connected with the cylinder, wherein the slider is connected with the first driving rod via the second driving rod; an inner magnet is arranged on the piston, and an outer magnetic ring is arranged on the slider.

Further, the first linkage assembly comprises a first link and a second link. One end of the first driving rod penetrates one end of the first link and the seat side plate assembly in turn, the first driving rod is connected with the first link, the other end of the first link is articulated with one end of the second link, and the other end of the second link is articulated with the ottoman assembly.

Further, the second linkage assembly comprises a third link, a fourth link, a fifth link, a sixth link and a seventh link. One end of the third link is articulated with the seat side plate assembly, the other end of the third link is articulated with one end of the fourth link, the other end of the fourth link is articulated with one end of the base, the middle part of the third link is articulated with one end of the fifth link, the other end of the fifth link is articulated with the middle part of the sixth link, one end of the sixth link is articulated with the backrest assembly and the seat side plate assembly respectively, and the other end of the sixth link is articulated with one end of the seventh link, and the other end of the seventh link is articulated with the other end of the base.

Further, the second linkage assembly comprises a eighth link, a ninth link and a tenth link. One end of the eighth link is articulated with a middle part of the fourth link, the other end of the eighth link is articulated with one end of the ninth link, a middle part of the ninth link is articulated with the seat side plate assembly, and the other end of the ninth link is articulated with one end of the tenth link, and the other end of the tenth link is articulated with the ottoman assembly.

Further, an upper end face of the tenth link is provided with an arc-shaped guide groove, and the third link is provided with a limit column, and the limit column can be slidingly connected with the arc-shaped guide groove.

Further, the seat side plate assembly comprises a first seat side plate and a second seat side plate, wherein a middle part of the second seat side plate is fixedly connected with one end of the first seat side plate, the backrest assembly is respectively articulated with one end of the second seat side plate and one end of the first seat side plate, and the other end of the second seat side plate is articulated with the sixth link; the middle part of the first seat side plate is articulated with the ninth link and the third link respectively, the other end of the first seat side plate is articulated with the ottoman assembly, and the first driving rod penetrates the middle part of the first seat side plate and is rotationally connected with the first seat side plate.

Further, the seat side assembly further comprises a mounting assembly connected to the first seat side plate.

Further, the backrest assembly comprises a first rotating rod, a second rotating rod, a third rotating rod and a fourth rotating rod, one end of the first rotating rod is articulated with the first seat side plate of the seat side plate assembly, the other end of the first rotating rod is articulated with one end of the second rotating rod, the middle part of the second rotating rod is articulated with one end of the third rotating rod, the other end of the third rotating rod is articulated with the sixth link of the second linkage assembly, the middle part of the third rotating rod is articulated with one end of the fourth rotating rod, and the other end of the fourth rotating rod is articulated with the second seat side plate of the seat side assembly.

Further, the chair frame further comprises a resetting member connected to the eighth link and the sixth link.

The disclosure has the beneficial effects that the driving mechanism of the disclosure can respectively provide power for the adjustment of the ottoman assembly and the seat side plate assembly, thus saving the power source required for the adjustment of the chair frame, and the position adjustment of the chair frame is convenient and quick; the seat side plate assembly and the second linkage assembly cooperate to drive the movement of the backrest assembly conveniently, the backrest assembly can move away from the wall while unfolding, and the backrest assembly will not interfere or conflict with the wall during unfolding or reclining, thereby realizing the zero-wall clearance placement of the chair frame in the closed position, saving the placement space of the chair frame, facilitating and smoothening position conversion of the chair frame, and improving the use experience of users.

DESCRIPTION OF THE REFERENCE NUMERALS

Figure 1:
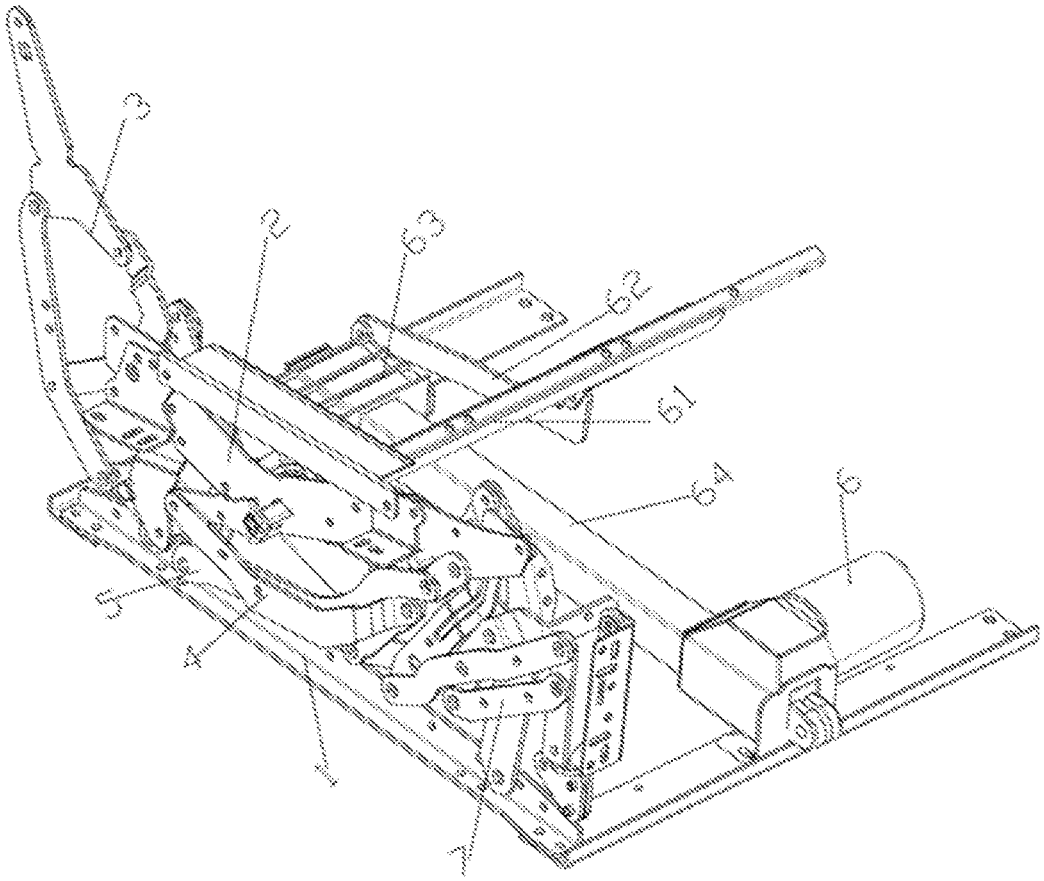
FIG. 1 is a partial schematic perspective view of a structure in a closed position of the present disclosure.

1. base; 2. seat side plate assembly; 3. backrest assembly; 4. first linkage assembly; 5. second linkage assembly; 6. driving mechanism; 7. ottoman assembly; 21. first seat side plate; 22. second seat side plate; 23. mounting assembly; 31. first rotating rod; 32. second rotating rod; 33. third rotating rod; 34. fourth rotating rod; 41. first link; 42. second link; 43. third link; 44. fourth link; 45. fifth link; 46. sixth link; 47. seventh link; 48. eighth link; 49. ninth link; 50. tenth link; 51. arc-shaped guide groove; 52. limit column; 61. first driving rod; 62. second driving rod; 63. slider; 64. cylinder.

DETAILED DESCRIPTION

For the sake of ease of understanding by those skilled in the art, the present disclosure will be further explained below in conjunction with the embodiments and the accompanying drawings, and the contents mentioned in the embodiments are not limitations to the present disclosure.

As shown in FIGS. 1 to 4, the present disclosure provides a zero-gravity and zero-wall chair frame, which comprising: a base 1, a seat side plate assembly 2, a first linkage assembly 4, ottoman assembly 7, a driving mechanism 6 arranged on the base 1, a second linkage assembly 5 articulated with the base 1 and the seat side plate assembly 2 respectively, a backrest assembly 3 articulated with the second linkage assembly 5 and the seat side plate assembly 2 respectively, and a first driving rod 61 connected with the output end of the driving mechanism 6. One end of the first driving rod 61 penetrates one end of first linkage assembly 4 and the seat side plate assembly 2 in turn, the first driving rod 61 is fixedly connected with the first linkage assembly 4, while the first driving rod 61 is rotationally connected with the seat side plate assembly 2, and the ottoman assembly 7 is articulated with the other end of the first linkage assembly 4 and the seat side plate assembly 2 respectively.

Specifically, the driving mechanism 6 can drive the first linkage assembly 4 and the ottoman assembly 7 to rotate relative to the seat side plate assembly 2 through the first driving rod 61. Furthermore, the driving mechanism can also drive the seat side plate assembly 2, the second linkage assembly 5 and the backrest assembly 3 to move in a direction away from or close to the backrest assembly 3 relative to the base 1 through the first driving rod 61; The driving mechanism 6 comprises a driver and a second driving rod 62, wherein the driver can adopt a magnetically coupled rodless cylinder. The driver comprises a cylinder 64, a piston arranged inside the cylinder 64 (not shown) and a slider 63 sleeved outside the cylinder 64 and slidingly connected with the cylinder 64, wherein the slider 63 is connected with the first driving rod 61 via the second driving rod 62. An inner magnet is arranged on the piston, and an outer magnetic ring is arranged on the slider 63, wherein the piston slides inside the cylinder 64 and attracts the slider 63 with the outer magnetic ring by the inner magnet to slide along the cylinder 64.

In an actual use, when the chair frame is in a closed position, the backrest assembly 3 of the chair frame is placed against the wall without clearance, at this time, the ottoman assembly 7 is in a contracted state, the seat side plate assembly 2 is in a flat state, the backrest assembly 3 is in a contracted or upright state, and the slider 63 is located on the side of the cylinder 64 close to the backrest assembly 3; when it is necessary to adjust the chair frame to the reclined state, the driver starts, the slider 63 slides along the side of the cylinder 64 away from the backrest assembly 3, the slider 63 drives the driving rod 61 to rotate relative to the seat side plate assembly 2 through the second driving rod 62, and drives the first linkage assembly 4 and the ottoman assembly 7 to rotate through the first driving rod 61. The first linkage assembly 4 cooperates with the seat side plate assembly 2 to unfold the ottoman assembly 7, thus realizing the transition from the closed position to the reclined position of the chair frame. When the chair frame is in the reclined position, the ottoman assembly 7 is fully unfolded, the ottoman assembly 7 can no longer rotate relative to the seat side panel assembly 2, and the ottoman assembly 7 restricts the rotation of the first driving rod 61 relative to the seat side plate assembly 2 through the first linkage assembly 4. At this time, the first linkage assembly 4, the ottoman assembly 7 and the seat side plate assembly 2 are in a locked state. When it is necessary to continue to adjust the chair frame from the reclined state to the zero-gravity position, the driver continues to drive the slider 63 to slide away from the backrest assembly 3, the first driving rod 61 is no longer rotated relative to the seat side plate assembly 2, and the slider 63 can push the seat side plate assembly 2, the ottoman assembly 7 and the backrest assembly 3 to move away from the wall through the second driving rod 62 and the first driving rod 61. At the same time, the second linkage assembly 5 can rotate relative to the base 1 and the seat side plate assembly 2 respectively, and the backrest assembly 3 is driven to move and unfold in the direction away from the wall by the cooperation of the second linkage assembly 5 and the seat side plate assembly 2; in addition, while the slider 63 drives the first driving rod 61 and the second driving rod 62 to move toward the ottoman assembly 7, the included angle between the second driving rod 62 and the base 1 increases continuously, and the second driving rod 62 continuously jacks up the first driving rod 61, the seat side plate assembly 2 and the ottoman plate assembly 7 in the vertical direction, so that the ottoman assembly 7 and one end of the the seat side plate assembly 2 close to the ottoman assembly 7 are inclined upward, and the one end of the seat side plate assembly 2 close to the backrest assembly 3 and the back assembly 3 are inclined downward, thereby facilitating reclining, so as to realize the transition of the chair frame from the reclined position to the zero-gravity position. The driving mechanism 6 of the disclosure can respectively provide power for the adjustment of the ottoman assembly 7 and the seat side plate assembly 2, thus saving the power source required for the adjustment of the chair frame, and the position adjustment of the chair frame is convenient and quick; the seat side plate assembly 2 and the second linkage assembly 5 cooperate to drive the movement of the backrest assembly conveniently, the backrest assembly 3 can move away from the wall while unfolding, and the backrest assembly 3 will not interfere or conflict with the wall during unfolding or reclining, thereby realizing the zero-wall clearance placement of the chair frame in the closed position, saving the placement space of the chair frame, facilitating and smoothening position conversion of the chair frame, and improving the use experience of users.

Figure 2:
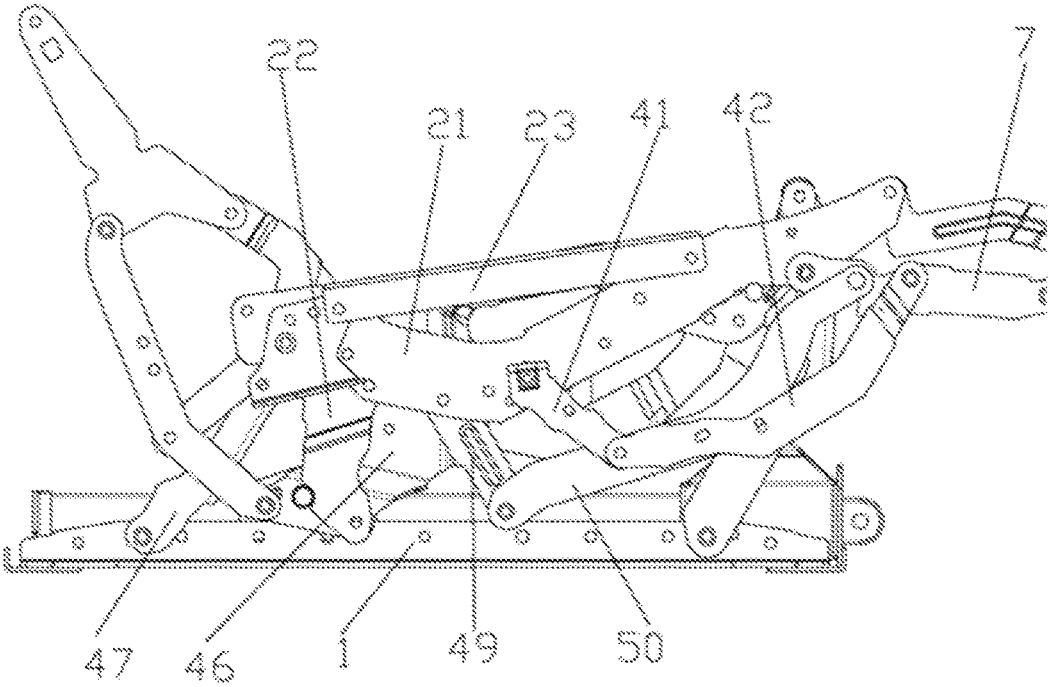
FIG. 2 is a partial schematic left view of a structure in a reclined position of the present disclosure.

As shown in FIG. 2, further, the first linkage assembly 4 comprises a first link 41 and a second link 42. One end of the first driving rod 61 penetrates one end of the first link 41 and the seat side plate assembly 2 in turn, the first driving rod 61 is fixedly connected with the first link 41, the other end of the first link 41 is articulated with one end of the second link 42, and the other end of the second link 42 is articulated with the ottoman assembly 7.

When the chair frame transitions from the closed position to the reclined position, the slider 63 drives the first link 41, the second link 42 and the ottoman assembly 7 to rotate relative to the seat side plate assembly 2 through the second driving rod 62 and the first driving rod 61, thereby unfolding the ottoman assembly 7. The first linkage assembly 4 has a simple structure, the ottoman assembly 7 is convenient to unfold and contract, and the ottoman assembly 7, the first linkage assembly 4 and the seat side plate assembly 2 are convenient to connect.

Figure 3:
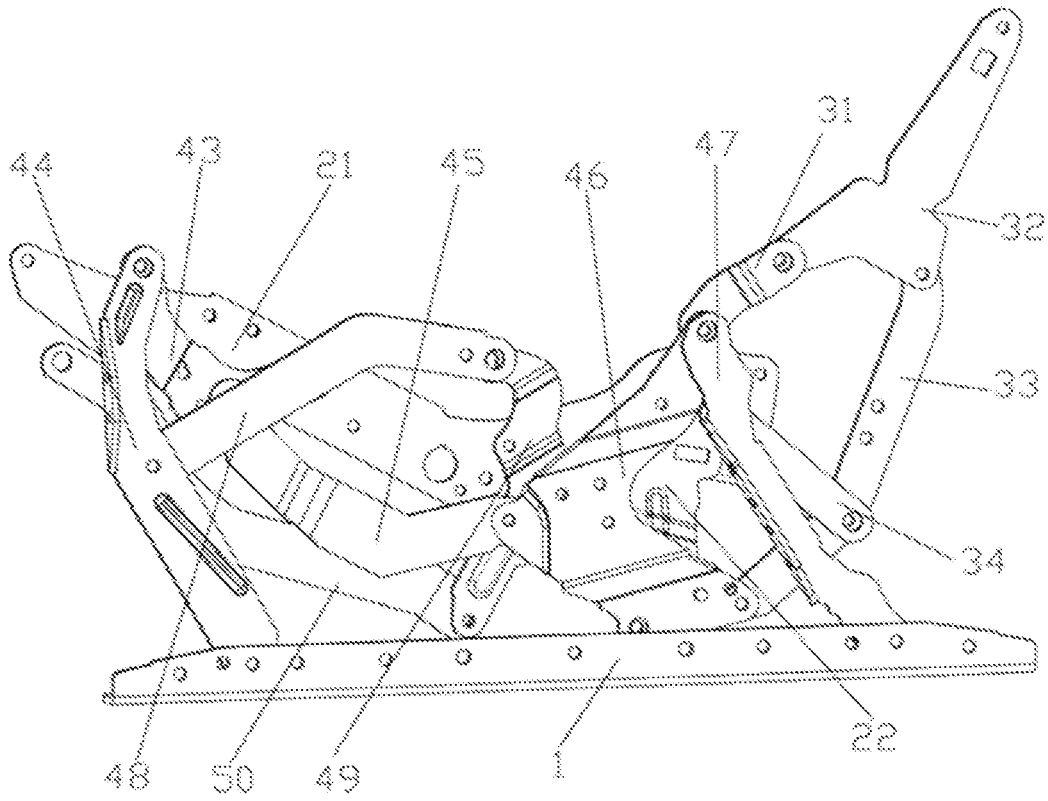
FIG. 3 is a partial schematic perspective view of a structure in the reclined position of the present disclosure.
Figure 4:
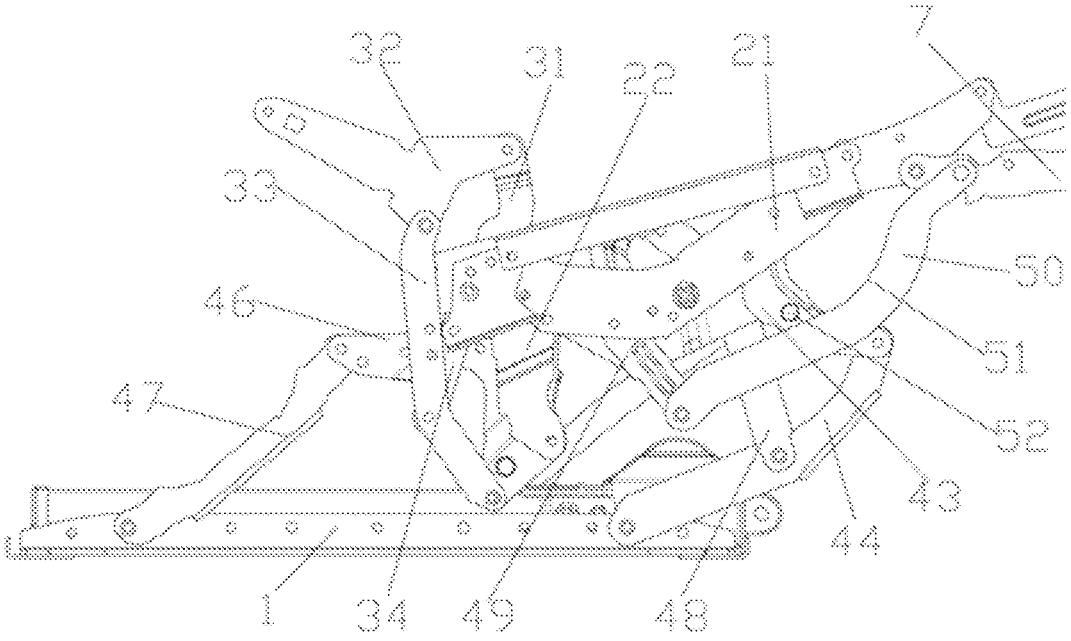
FIG. 4 is a partial schematic left view of a structure in a zero-gravity position of the present disclosure, in which a first linkage assembly is hidden.

As shown in FIGS. 3 to 4, further, the second linkage assembly 5 comprises a third link 43, a fourth link 44, a fifth link 45, a sixth link 46 and a seventh link 47. One end of the third link 43 is articulated with the seat side plate assembly 2, the other end of the third link 43 is articulated with one end of the fourth link 44, the other end of the fourth link 44 is articulated with one end of the base 1, the middle part of the third link 43 is articulated with one end of the fifth link 45, the other end of the fifth link 45 is articulated with the middle part of the sixth link 46, one end of the sixth link 46 is articulated with the backrest assembly 3 and the seat side plate assembly 2 respectively, and the other end of the sixth link 46 is articulated with one end of the seventh link 47, and the other end of the seventh link 47 is articulated with the other end of the base 1.

When the chair frame is adjusted from the reclined state to the zero-gravity position, the seat side plate assembly 2 rotates the fourth link 44 relative to the base 1 toward the ottoman assembly 7 through the third link 43. Meanwhile, the third link 43 can also rotate the seventh link 47 relative to the base 1 toward the ottoman assembly 7 through the fifth link 45 and the sixth link 46. The sixth link 46 cooperates with the seat side plate assembly 2 to drive the backrest assembly 3 away from the wall and unfold. The second linkage assembly 5 has a simple structure and is conveniently connected with the seat side plate assembly 2 and the base 1. The second linkage assembly 5 can not only provide guidance for the movement of the seat side plate assembly 2 and the backrest assembly 3 away from the wall relative to the base 1, but also cooperate with the seat side plate assembly 2 to unfold the backrest assembly 3. The backrest assembly 3 is convenient to unfold and move, which is beneficial to placing the chair frame against the wall at zero clearance in the closed position.

Further, the second linkage assembly 5 comprises a eighth link 48, a ninth link 49 and a tenth link 50. One end of the eighth link 48 is articulated with a middle part of the fourth link 44, the other end of the eighth link 48 is articulated with one end of the ninth link 49, a middle part of the ninth link 49 is articulated with the seat side plate assembly 2, and the other end of the ninth link 49 is articulated with one end of the tenth link 50, and the other end of the tenth link 50 is articulated with the ottoman assembly 7.

When the chair frame transitions from the closed position to the reclined position, the first linkage assembly 4 cooperates with the seat side plate assembly 2 to unfold the ottoman assembly 7. The ottoman Assembly 7 can also rotate the tenth link 50 and the ninth link 49 relative to the seat side plate assembly 2 while being unfolded. When the ottoman assembly 7 is fully unfolded, the chair frame switches to a reclined position, and the ottoman assembly 7 can no longer rotate relative to the seat side plate assembly 2. The ottoman assembly 7 restricts the rotation of the ninth link 49 relative to the seat side plate assembly 2 through the tenth link 50, that is, the tenth link 50, the ninth link 49, the ottoman assembly 7 and the seat side plate assembly 2 are in a locked state. At this time, the ottoman assembly 7, the first linkage assembly 4 and the seat side plate assembly 2 are also in a locked state. When the chair frame continues to transition from the reclined position to the zero-gravity position, the chair frame can rotate the eighth link 48 and the fourth link 44 relative to the base 1 in a direction away from the backrest assembly 3 by pushing the ninth link 49, so that the position transition of the chair frame is smoother.

As shown in FIG. 4, further, an upper end face of the tenth link 50 is provided with an arc-shaped guide groove 51, and the third link 43 is provided with a limit column 52, wherein the limit column 52 can be slidingly connected with the arc-shaped guide groove 51.

When the chair frame transitions from the reclined position to the zero-gravity position, the tenth link 50, the ninth link 49 and the ottoman assembly 7 are in the locked state, and the third link 43 rotates relative to the fourth link 44 and the seat side plate assembly 2, wherein, during the rotation of the third link 43, the limit column 52 slides into the arc-shaped guide groove 51 and can slide upward relative to the arc-shaped guide groove 51. Because the tenth link 50 is in the locked state, the arc-shaped guide groove 51 can limit and guide the rotation of the limit column 52 and the third link 43, thereby improving the accuracy and stability during the rotation of the third link 43. When the chair frame shifts from the zero-gravity position to the reclined position, during the rotation of the third link 43, the limit column 52 can slide downwardly inside the arcuate guiding groove 51 and then slide out of the arc-shaped guide groove 51, thereby improving the smoothness of the chair frame position shift.

Further, the seat side plate assembly 2 comprises a first seat side plate 21 and a second seat side plate 22, wherein a middle part of the second seat side plate 22 is fixedly connected with one end of the first seat side plate 21, the backrest assembly 3 is respectively articulated with one end of the second seat side plate 22 and one end of the first seat side plate 21, and the other end of the second seat side plate 22 is articulated with the sixth link 46; the middle part of the first seat side plate 21 is articulated with the ninth link 49 and the third link 43 respectively, the other end of the first seat side plate 21 is articulated with the ottoman assembly 7, and the first driving rod 61 penetrates the middle part of the first seat side plate 21 and is rotationally connected with the first seat side plate 21.

In particular, the seat side plate assembly 2 further includes a mounting assembly 23 connected to the first seat side plate 21, the mounting assembly 23 can be connected to the external seat cushion, and the seat side plate assembly 2 can be conveniently connected to the external seat cushion. In the actual use, the first seat side plate 21 is respectively connected with the ottoman assembly 7, the first driving rod 61 and the second linkage assembly 5, so that the second linkage assembly 5, the first driving rod 61 and the ottoman assembly 7 do not interfere or conflict during the movement process. The backrest assembly 3 is connected to the sixth link 46, the second seat side plate 22 and the first seat side plate 21, respectively, so that the seat side plate assembly 2 drives the backrest assembly 3 to move away from the wall, and the seat side plate assembly 2 has a simple and compact structure.

Further, the backrest assembly 3 comprises a first rotating rod 31, a second rotating rod 32, a third rotating rod 33 and a fourth rotating rod 34. One end of the first rotating rod 31 is articulated with the first seat side plate 21, the other end of the first rotating rod 31 is articulated with one end of the second rotating rod 32, the middle part of the second rotating rod 32 is articulated with one end of the third rotating rod 33, the other end of the third rotating rod 33 is articulated with the sixth link 46, the middle part of the third rotating rod 33 is articulated with one end of the fourth rotating rod 34, and the other end of the fourth rotating rod 34 is articulated with the second seat side plate 22.

When the chair frame transitions from the reclined position to the zero-gravity position, the first seat side plate 21 drives the back assembly 3 to move away from the wall as a whole, and drives the fourth rotating rod 34, the third link 43, the second link 42 and the first link 41 to rotate by the sixth link 46, thus unfolding of the backrest assembly 3. The backrest assembly 3 is simple and compact in structure, wherein the fourth rotating rod 34 is connected with the sixth link 46, so that the second linkage assembly 5 can drive the backrest assembly 3 to rotate relative to the first seat side plate 21, and the backrest assembly 3 can be expanded and contracted conveniently. The fourth rotating rod 34 and the first rotating rod 31 being respectively connected with the seat side plate assembly 2, which is convenient for the seat side plate assembly 2 to synchronously drive the backrest assembly 3 to move away from the wall, so that the backrest assembly 3 can be placed against the wall in a closed position and improves the space utilization rate.

Further, the chair frame further comprises a resetting member (not shown) connected to the eighth link 48 and the sixth link 46.

In particular, the resetting part may be an elastic member, such as a spring, a tension spring, etc. One end of the eighth link 48 near the ninth link 49 is connected to one end of the resetting member, and one end of the sixth link 46 near the seventh link 47 is connected to the other end of the resetting member. When the chair frame transitions from the reclined position to the zero-gravity position, the distance between the sixth link 46 and the eighth link 48 increases continuously, and the resetting member is stretched and stores elastic potential energy. When the chair frame changes from the zero-gravity position to the reclined position, the resetting member releases the elastic potential energy and drives the sixth link 46 and the eighth link 48 to approach each other, and the fourth link 44 is pulled by the eighth link 48 to rotate relative to the base 1 in a direction close to the back assembly 3, which is beneficial to the rapid conversion of the chair frame position and improves the conversion efficiency of the chair frame position.

All technical features in this embodiment can be freely combined according to actual needs.

The above-mentioned embodiment is a preferred implementation scheme of the disclosure. Besides, the present disclosure can also be implemented in alternative ways. Any obvious alternative is within the scope of the disclosure without departing from the conception of the present invention.

The invention claimed is:

1. A zero-gravity and zero-wall chair frame, wherein the chair frame comprising: a base, a seat side plate assembly, a first linkage assembly, an ottoman assembly, a driving mechanism arranged on the base, a second linkage assembly articulated with the base and the seat side plate assembly respectively, a backrest assembly articulated with the second linkage assembly and the seat side plate assembly respectively, and a first driving rod connected with the output end of the driving mechanism, the first linkiage assembly comprises a first link and a second link, wherein one end of the first driving rod penetrates the seat side plate assembly and one end of the first link of the first linkage assembly in turn, the first driving rod is rotationally connected with the seat side plate assembly, and the first driving rod is connected with one end of the first link, the other end of the first link is articulated with one end of the second link, and the other end of the second link is articulated with the ottoman assembly.

2. The zero-gravity and zero-wall chair frame according to claim 1, wherein the driving mechanism comprises a driver and a second driving rod, wherein the driver comprises a cylinder, a piston arranged inside the cylinder and a slider sleeved outside the cylinder and slidingly connected with the cylinder, wherein the slider is connected with the first driving rod via the second driving rod; an inner magnet is arranged on the piston, and an outer magnetic ring is arranged on the slider.

3. The zero-gravity and zero-wall chair frame according to claim 1, wherein the second linkage assembly comprises a third link, a fourth link, a fifth link, a sixth link and a seventh link, one end of the third link is articulated with the seat side plate assembly, the other end of the third link is articulated with one end of the fourth link, the other end of the fourth link is articulated with one end of the base, the middle part of the third link is articulated with one end of the fifth link, the other end of the fifth link is articulated with the middle part of the sixth link, one end of the sixth link is articulated with the backrest assembly and the seat side plate assembly respectively, and the other end of the sixth link is articulated with one end of the seventh link, and the other end of the seventh link is articulated with the other end of the base.

4. The zero-gravity and zero-wall chair frame according to claim 3, wherein the second linkage assembly further comprises a eighth link, a ninth link and a tenth link, one end of the eighth link is articulated with a middle part of the fourth link, the other end of the eighth link is articulated with one end of the ninth link, a middle part of the ninth link is articulated with the seat side plate assembly, and the other end of the ninth link is articulated with one end of the tenth link, and the other end of the tenth link is articulated with the ottoman assembly.

5. The zero-gravity and zero-wall chair frame according to claim 4, wherein an upper end face of the tenth link is provided with an arc-shaped guide groove, and the third link is provided with a limit column, and the limit column can be slidingly connected with the arc-shaped guide groove.

6. The zero-gravity and zero-wall chair frame according to claim 4, wherein the seat side plate assembly comprises a first seat side plate and a second seat side plate, wherein a middle part of the second seat side plate is fixedly connected with one end of the first seat side plate, the backrest assembly is respectively articulated with one end of the second seat side plate and one end of the first seat side plate, and the other end of the second seat side plate is articulated with the sixth link; the middle part of the first seat side plate is articulated with the ninth link and the third link respectively, the other end of the first seat side plate is articulated with the ottoman assembly, and the first driving rod penetrates the middle part of the first seat side plate and is rotationally connected with the first seat side plate.

7. The zero-gravity and zero-wall chair frame according to claim 6, wherein the seat side plate assembly further comprises a mounting assembly connected to the first seat side plate.

8. The zero-gravity and zero-wall chair frame according to claim 1, wherein the backrest assembly comprises a first rotating rod, a second rotating rod, a third rotating rod and a fourth rotating rod, one end of the first rotating rod is articulated with the first seat side plate of the seat side plate assembly, the other end of the first rotating rod is articulated with one end of the second rotating rod, the middle part of the second rotating rod is articulated with one end of the third rotating rod, the other end of the third rotating rod is articulated with the sixth link of the second linkage assembly, the middle part of the third rotating rod is articulated with one end of the fourth rotating rod, and the other end of the fourth rotating rod is articulated with the second seat side plate of the seat side assembly.

9. The zero-gravity and zero-wall chair frame according to claim 4, wherein the chair frame further comprises a resetting member connected to the eighth link and the sixth link.

* * * * *